United States Patent [19]

Buuck et al.

[11] Patent Number: 4,815,424

[45] Date of Patent: Mar. 28, 1989

[54] HYDRAULIC LASH ADJUSTER

[75] Inventors: Bryce A. Buuck; John P. Chapman; David P. Clark, all of Battle Creek, Mich.

[73] Assignee: Eaton Corporation, Cleveland, Ohio

[21] Appl. No.: 167,225

[22] Filed: Mar. 11, 1988

[51] Int. Cl.[4] ..... F01L 1/24

[52] U.S. Cl. ..... 123/90.46; 123/90.55

[58] Field of Search ..... 123/90.46, 90.55, 90.57, 123/90.49

[56] References Cited

U.S. PATENT DOCUMENTS

| | | | |
|---|---|---|---|
| 4,502,428 | 3/1985 | Paar | 123/90.46 |
| 4,570,582 | 2/1986 | Speil | 123/90.46 |
| 4,708,103 | 11/1987 | Speil | 123/90.46 |
| 4,716,867 | 1/1988 | Speil | 123/90.46 |
| 4,724,822 | 2/1988 | Bonvallet | 123/90.46 |
| 4,729,350 | 3/1988 | Speil | 123/90.55 |

FOREIGN PATENT DOCUMENTS

| | | | |
|---|---|---|---|
| 0892394 | 8/1953 | Fed. Rep. of Germany | 123/90.46 |

*Primary Examiner*—Willis R. Wolfe
*Assistant Examiner*—M. Macy
*Attorney, Agent, or Firm*—F. M. Sajovec

[57] ABSTRACT

A hydraulic lash adjuster which is mounted in a rocker arm of an internal combustion engine. The plunger of the lash adjuster has a socket formed therein which receives a cylindrical member having a ball end in contact with the socket and a flat surface engageable with a poppet valve of the engine. The ball and socket connection is lubricated by engine oil flowing from the leakdown clearance space between the plunger and the lash adjuster body through a passage which intersects the socket surface. The plunger and the cylindrical member are retained within the body by a single, dish-shaped member which is positioned over the body.

15 Claims, 1 Drawing Sheet

HYDRAULIC LASH ADJUSTER

The present invention relates to hydraulic lash adjusters for internal combustion engines, and more particularly to a hydraulic lash adjuster which is mounted in a rocker arm assembly of the engine.

Lash adjusters of the type which are mounted in a rocker arm such that they act directly on the tip of a poppet valve, often referred to as "integral" lash adjusters, are necessarily very small as compared with other types of lash adjusters. A problem which arises with the use of these small lash adjusters is that the contact stress between the adjuster and the valve stem can be very high, resulting in accelerated wear of the lash adjuster and/or valve stem, and possible premature valve train failure.

Three types of contact geometries between the lash adjuster and the valve stem are in current use in engine valve trains, including a spherical-ended lash adjuster in contact with a flat-ended valve stem; a cylindrical-ended lash adjuster in contact with a flat-ended valve stem; and a lash adjuster incorporating a ball-and-socket assembly which has a flat end in contact with a flat-ended valve stem. Of the above, the type incorporating a ball-and-socket assembly in the lash adjuster is the most desirable in integral lash adjuster applications since the theoretical contact geometry is circular contact within the ball-and-socket structure and planar contact between the lash adjuster and the valve stem. Theoretically, the spherical-ended design results in point contact between the lash adjuster and valve stem, and the cylindrical design results in line contact, both of which can produce unacceptably high contact stress.

Ball-and-socket designs for such applications are in current use; however, the known type employs a spherical-ended lash adjuster body with a mating socket member having a flat end in contact with the valve stem, and requires a separate member to retain the socket member on the body.

What the present invention seeks to provide is a hydraulic lash adjuster of the type mounted in a rocker arm which is subject to relatively low contact stress between the adjuster and the contacting valve stem. More specifically, the invention is intended to provide a lash adjuster employing a ball-and-socket assembly in contact with the valve stem which has a minimum net length, and which requires fewer component parts than prior art designs, while providing improved wearability and thus longer life as compared with previous designs.

To meet the above objectives the present invention provides a hydraulic lash adjuster adapted to be mounted in a rocker arm which includes a body received in a bore formed in the rocker arm; a plunger having a socket formed in the outer end thereof; and a ball end member engageable with the socket and having a flat faced end portion engageable with the stem of a poppet valve, the end member and the plunger being retained within the body by a single retaining member. Also in accordance with the invention the ball end is lubricated by means of engine oil metered into the interface between the ball end and socket.

Other features and advantages of the present invention will be apparent from the following description when considered in connection with the accompanying drawings, wherein.

Figure 1:
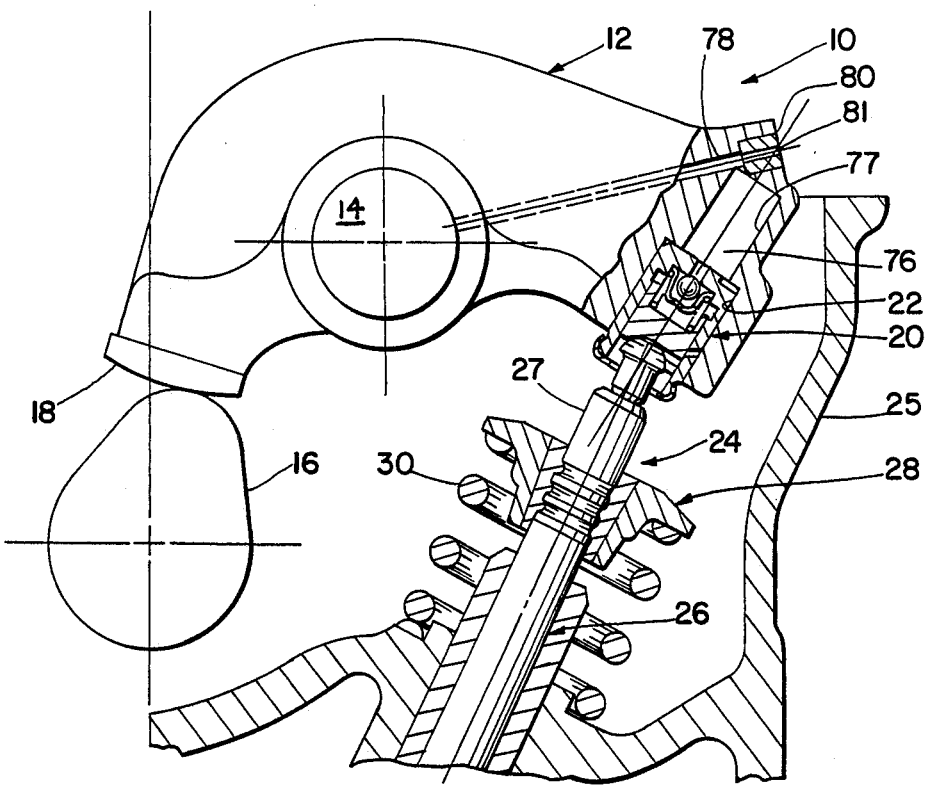
FIG. 1 is a side elevation view, with parts shown in section, of a portion of the valve train of an internal combusion engine incorporating the invention.

Referring to FIG. 1 there is illustrated a portion 10 of a valve train for an internal combustion engine comprising a rocker arm 12 mounted for rotation on a pivot 14, an operating cam 16 acting on a cam follower portion 18 of the rocker arm, the lash adjuster assembly 20 of the present invention mounted within a bore 22 formed in the rocker arm, and a poppet valve assembly 24 received in the engine block 25 and in engagement with the lash adjuster assembly. The poppet valve assembly comprises a poppet valve 26 having a stem 27 and head (not shown), a spring retainer 28 and a spring 30 which biases the valve in a normally closed position.

Figure 2:
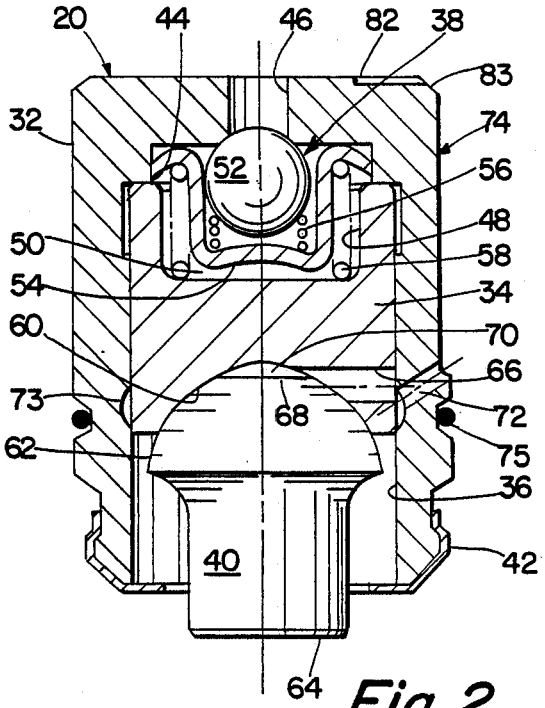
FIG. 2 is an enlarged sectional view of the lash adjuster of the present invention.

Referring particularly to FIG. 2, the lash adjuster assembly 20 comprises a cylindrical body 32 which is received in the bore 22 of the rocker arm, a plunger 34 which is received in close sliding fit within a bore 36 formed in the body, a check valve assembly 38 acting between the plunger and the body, a valve engagement member 40 acting between the plunger and the valve stem, and a retaining member 42 attached to the body 32 and serving to retain the engagement member and the plunger within the body prior to the installation of the lash adjuster in the engine.

The bore 36 is essentially a blind bore with a counterbore 44 formed at the bottom thereof. A passage 46 coaxial with the bore 36 is formed in the closed end of the body and intersects the bottom of the counterbore 44 to define a seat for the check valve. The plunger 34 has a cavity 48 formed in one end thereof. A high pressure chamber 50 is defined by the volume below the check valve bounded by the body and the plunger, including the counterbore 44 and the cavity 48.

A ball valve 52 is located in the high pressure chamber and is engageable with the seat defined at the intersection of passage 46 and counterbore 44. A cage member 54 is pressed into the counterbore 44, and a small spring 56 acts between the cage and the ball valve 52 to bias the ball valve into engagement with the seat. A second spring 58 acts between the cage and the plunger to bias the plunger outward from the body.

In accordance with the present invention, a socket 60 is formed in the end of the plunger 34 and is engaged by the valve engagement member 40. The valve engagement member 40 is a short rod member having a ball end engageable with the socket 60 formed at one end and a flat surface 64 engageable with the end of the valve stem 26 formed at the other end. When the check valve assembly 38 and plunger 34 are assembled into the body 32 the engagement member 40 is inserted into the bore 36 and the retaining member 42 is positioned in an annular groove formed in the body to retain the plunger and the valve engagement member in place until the assembly of the valve train components is completed.

To provide lubrication for the ball and socket connection between the plunger 34 and the valve engagement member 40, a radial oil port 66 is formed in the plunger, intersecting the surface of the socket 60. Oil which flows in the controlled clearance space between the plunger 34 and the body 32 enters the port 66 and flows into the interface between the socket 60 and the ball end 62. To insure that sufficient lubricant is available at the interface between the ball and socket elements, a flat 68 is formed at the top of the ball end 62 to define a small oil reservoir space 70.

Figure 3:
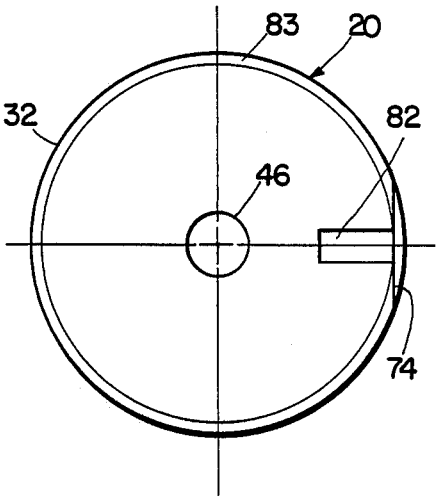
FIG. 3 is a plan view of the lash adjuster of FIG. 2.

Oil passing between the plunger and the body is also recirculated to a reservoir chamber 76 defined by a reduced diameter bore 77 formed in the rocker arm coaxial with the bore 22. To provide a recirculation path, an oil port 72 is formed through the wall of the body 32 and communicates with an annular groove 73 formed in the body. Referring particularly to FIG. 3 an axial flat 74 is formed along the outer diameter of the body stopping essentially at the lower edge of the oil port 72 to provide an oil passaqe along the body when the lash adjuster is installed in the rocker arm. An O-ring 75 received in a groove formed in the body 32 forms a seal between the body and the bore 22. As shown in FIG. 1, the intersection of the bore 22 with the reduced diameter bore 77 defines a seat for the lash adjuster assembly.

To supply oil to the lash adjuster, an oil passage 78 is formed in the rocker arm, intersecting the reservoir chamber 76 at one end and oil supply passages (not shown) within the rocker arm pivot at the other end to route oil from the engine oil pump to the reservoir chamber. The outer end of passage 78 is substantially closed by a plug 80 having a small air bleed hole 81 formed therethrough.

Referring particularly to FIG. 3, a radially extending notch 82 is formed in the top of body 32, intersecting a chamfer 83 formed at the outer edge of the body and extending inwardly sufficiently to open into the reservoir chamber 76. The chamfer also intersects the passage defined by the flat 74, thus completing a recirculation oil path from the port 72 to the reservoir chamber 76.

In operation, the reservoir chamber 76 receives oil from the engine oil pump. Initially, the base circle of the cam 16 is in contact with the rocker arm and the plunger 34 is biased outward of the body 32 by the spring 58 to provide zero clearance between the engagement member 40 of the lash adjuster and the valve 26. When the engine is started and the cam 16 rotates, the valve opening force applied by the plunger acting against the valve stem through the ball and socket member 40 causes the pressure in chamber 50 to increase to the point where the ball valve 52 is closed. At this time oil flows out of the high pressure chamber 50 through the leakdown path between the plunger and the body and the plunger 34 is moved upward a certain distance within the body. When he camshaft is further rotated to its minimum cam radius and there is clearance between the valve tip and the engagement member 40, the plunger 34 moves downward again by means of the biasing force of spring 58. As a result the oil pressure within chamber 50 is reduced and the ball valve 52 becomes unseated permitting oil to flow through passage 46 and into the chamber. The lash adjuster is then returned to its required length to provide zero clearance between the member 40 and the valve tip, the above movement of the plunger being repeated continuously during operation of the engine.

During operation of the engine a portion of the leakdown oil will flow into the radial port 66 and into the ball and socket joint while the remainder flows into the annular groove 73 and through port 72, between the body and the bore 22 along flat 74 and into the reservoir 76 via the notch 82. This provides sufficient oil to the ball and socket joint to insure proper lubrication thereof. The reservoir space 70 between the bottom of the socket 60 and the flat 68 on the ball end serves to further insure that lubricating oil will be available to the ball and socket under all operating conditions as well as after a period of engine shutdown. As illustrated in FIG. 2 the port 66 can intersect the annular groove 73. While such intersection can provide additional oil to the ball-and-socket under some conditions, it is not considered to be essential to the basic operation of the invention.

We claim:

1. A hydraulic lash adjuster adapted to be mounted in a rocker arm of a valve train assembly of an internal combustion engine, comprising a cylindrical body; a plunger received in a bore formed in said body, said plunger interfitting with said bore to define a controlled fluid leakdown clearance therebetween; means formed in said body and plunger defining a pressure chamber; one way valve means within said pressure chamber, said one way valve means permitting fluid flow into said pressure chamber; biasing means acting between said plunger and said body applying a force tending to move said plunger outward of said body; and a recirculation passage formed through a wall of said body, said recirculation passage intersecting the leakdown clearance between said plunger and said body; the improvement comprising a socket formed in an end of said plunger; a cylindrical member engageable with said socket, said cylindrical member having a generally spherical surface formed at one end thereof for engagement with said socket, and a flat surface formed at the opposite end for engagement with a poppet valve of said engine; a port formed through the wall of said plunger and defining a conduit between said leakdown clearance and said socket; whereby leakdown oil flows into said port and into the interface between said socket and said cylindrical member to provide lubricant to said interface.

2. Apparatus as claimed in claim 1 including a circumferential collector groove formed in said body communicating with said recirculation passage, said collector groove being positioned to intersect said port.

3. Apparatus as claimed in claim 1 in which the spherical end of said cylindrical member has a diameter greater than the diameter of said flat end, said apparatus further including retaining means engageable with said body and operable to retain said plunger and said cylindrical member within said body.

4. Apparatus as claimed in claim 3 in which said retaining means comprises a substantially dish-shaped member engageable with said body and having a central opening formed therein, said central opening being smaller than the spherical end of said cylindrical member but larger than the flat end of said cylindrical member.

5. Apparatus as claimed in claim 1, wherein a reservoir space is defined between said spherical end and said socket, said port formed in said plunger intersecting said reservoir space.

6. Apparatus as claimed in claim 5, including a flat formed in the spherical surface of said cylindrical member, said flat defining a boundary of said reservoir space.

7. In a rocker arm of an internal combustion engine valve train assembly, an assembly cavity formed in said rocker arm, a hydraulic lash adjuster assembly received in a portion of said cavity, the remainder of said cavity defining a fluid reservoir; said hydraulic lash adjuster assembly comprising a cylindrical body, a plunger received in a bore formed in said body with a controlled leakdown clearance formed between said plunger and said bore, means formed in said body and in said plunger defining a pressure chamber, an inlet port formed in said body connecting said fluid reservoir and said pressure chamber, one way valve means within said pressure chamber permitting fluid flow from said fluid reservoir to said pressure chamber, biasing means acting between said plunger and said body applying a force tending to move said plunger outward of said body, a recirculation passage formed through a wall of said body and intersecting the leakdown clearance between the plunger and the body, and passage means connecting said recirculation passage with said fluid reservoir; the improvement comprising a socket formed in said plunger; a cylindrical member engageable with said socket, said cylindrical member having a generally spherical surface formed at one end thereof for engagement with said socket, and a flat surface formed at the opposite end for engagement with a poppet valve of said engine, and a lubrication port formed in said plunger and defining a fluid flow path between said leakdown clearance and said socket.

8. Apparatus as claimed in claim 7 including a circumferential collector groove formed in said body communicating with said recirculation passage, said collector groove being positioned to intersect said port.

9. Apparatus as claimed in claim 7, in which said means connecting said recirculation passage with said reservoir comprises a passage defined in part by a longitudinal flat formed in the outer surface of the body and intersecting said recirculation passage.

10. Apparatus as claimed in claim 7 in which the spherical end of said cylindrical member has a diameter greater than the diameter of said flat end, said apparatus further including retaining means engageable with said body and operable to retain said plunger and said cylindrical member within said body.

11. Apparatus as claimed in claim 10 in which said retaining means comprises a substantially dish-shaped member engageable with said body and having a central opening formed therein, said central opening being smaller than the spherical end of said cylindrical member but larger than the flat end of said cylindrical member.

12. Apparatus as claimed in claim 7, wherein a reservoir space is defined between said spherical end and said socket, said port formed in said plunger intersecting said reservoir space.

13. Apparatus as claimed in claim 12, including flat formed in the spherical surface of said cylindrical member, said flat defining a boundary of said reservoir space.

14. A hydraulic lash adjuster adapted to be mounted in a rocker arm of a valve train assembly of an internal combustion engine, comprising a cylindrical body; a plunger received in a bore formed in said body, said plunger interfitting with said bore to define a controlled fluid leakdown clearance therebetween; means formed in said body and plunger defining a pressure chamber; one way valve means within said pressure chamber, said one way valve means permitting fluid flow into said pressure chamber; biasing means acting between said plunger and said body applying a force tending to move said plunger outward of said body; and a recirculation passage formed through a wall of said body, said recirculation passage intersecting the leakdown clearance between said plunger and said body; the improvement comprising a socket formed in an end of said plunger; a cylindrical member engageable with said socket, said cylindrical member having a generally spherical surface formed at one end thereof for engagement with said socket, and a flat surface formed at the opposite end for engagement with a poppet valve of said engine, the spherical end of said cylindrical member having a diameter greater than the diameter of said flat end; and retaining means engageable with said body and operable to retain said plunger and said cylindrical member within said body.

15. Apparatus as claimed in claim 14 in which said retaining means comprises a substantially dish-shaped member engageable with said body and having a central opening formed therein, said central opening being smaller than the spherical end of said cylindrical member but larger than the flat end of said cylindrical member.

* * * * *